US009664196B2

(12) United States Patent
Higuchi et al.

(10) Patent No.: US 9,664,196 B2
(45) Date of Patent: May 30, 2017

(54) AXIAL FLOW FAN MOTOR

(71) Applicant: MINEBEA CO., LTD., Kitasaku-gun, Nagano (JP)

(72) Inventors: Yukihiro Higuchi, Fukuroi (JP); Atsushi Taroda, Kakegawa (JP)

(73) Assignee: MINEBEA CO., LTD., Kitasaku-gun (JP)

( * ) Notice: Subject to any disclaimer, the term of this patent is extended or adjusted under 35 U.S.C. 154(b) by 255 days.

(21) Appl. No.: 14/454,527

(22) Filed: Aug. 7, 2014

(65) Prior Publication Data

US 2015/0064029 A1 Mar. 5, 2015

(30) Foreign Application Priority Data

Aug. 29, 2013 (JP) ..... 2013-178493

(51) Int. Cl.
*F04D 29/54* (2006.01)
*F04D 25/06* (2006.01)

(52) U.S. Cl.
CPC ..... *F04D 25/0613* (2013.01); *F04D 29/542* (2013.01); *F04D 29/547* (2013.01)

(58) Field of Classification Search
CPC ..... F04D 29/325; F04D 29/326; F04D 29/329
See application file for complete search history.

(56) References Cited

U.S. PATENT DOCUMENTS 6,368,081 B1 * 4/2002 Matsumoto ..... F04D 25/082 417/423.1
8,540,496 B2 9/2013 Suzuki et al.
2011/0200429 A1 * 8/2011 Higo ..... F04D 25/0613 415/191

FOREIGN PATENT DOCUMENTS

JP A-2003-314499 11/2003
JP A-2004-316625 11/2004
JP 2007529681 A 10/2007
JP 2010196574 A 9/2010
WO 2005091896 A2 10/2005

OTHER PUBLICATIONS

Jan. 24, 2017 Office Action issued in Japanese Patent Application No. 2013-178493.

* cited by examiner

*Primary Examiner* — Patrick Hamo
(74) *Attorney, Agent, or Firm* — Oliff PLC

(57) ABSTRACT

An axial flow fan motor 100 comprises: a casing outer frame 61; an impeller 10; a rotor shaft 20 as a rotation axis at a center of the impeller 10; a bearing housing 30 in an inside of a rotor housing 11; and a base portion hub 62 in an air blowout opening side 2, wherein, in a cross-sectional view along the rotation axis, the base portion hub 62 has an outer peripheral portion 65 at least partially inclined to the rotation axis side by an angle θ1 toward the air blowout opening side 2 with regard to a straight line parallel to the rotation axis, and the casing outer frame 61 has an inner peripheral portion 67 at least partially inclined to the rotation axis side by an angle θ2 toward the air blowout opening side 2 with regard to a straight line parallel to the rotation axis.

8 Claims, 9 Drawing Sheets

AXIAL FLOW FAN MOTOR

TECHNICAL FIELD

The present invention is related to an axial flow fan motor.

BACKGROUND ART

A fan is used for cooling home appliances, communication equipment, servers, and the like (for example, refer to Japanese Laid-open Patent Application Publications No. 2004-316625 and No. 2003-314499). In the fan disclosed in FIG. 2D of Japanese Laid-open Patent Application Publication No. 2004-316625, so that the openings of the suction opening side and the blowout opening side become wide and the air flow increases, the inner peripheral portion of the casing outer frame of the suction opening side is inclined outward toward the suction opening side, and the inner peripheral portion of the casing outer frame of the blowout opening side is also inclined outward toward the blowout opening side.

Further, in the fan disclosed in FIG. 3A of Japanese Laid-open Patent Application Publication No. 2004-316625, apart from the above description, the inner peripheral portion of the casing outer frame is inclined to the central axis direction toward the blowout opening side from the suction opening side and the air flow is directed to the central axis direction, so that the larger amount of air flow flows to the electronic equipment in the vicinity of the center. In addition, the outer peripheral portion of the base portion hub of the fan of Japanese Laid-open Patent Application Publication No. 2004-316625 is formed in a straight configuration. That is, the outer peripheral portion of the base portion hub is formed in a straight outer diameter shape along the central axis toward the blowout opening.

Further, in the fan disclosed in Japanese Laid-open Patent Application Publication No. 2003-314499, it is intended to widen the opening in the blowout opening side and to increase the air flow volume by inclining the outer peripheral portion of the base portion hub to the central axis direction toward the blowout opening side. In addition, the inner peripheral portion of the casing outer frame of the fan of Japanese Laid-open Patent Application Publication No. 2004-316625 is formed in a straight configuration. That is, the inner peripheral portion of the casing outer frame is formed in a straight inner diameter shape along the central axis toward the blowout opening side from the suction opening side.

Meanwhile, with regard to a fan, a medium air flow volume region (0.5~1.0 $m^3$/min) is often used as an operating point, and so high static pressure efficiency (=(static pressure×air flow volume)/power consumption) and low power consumption are required in the medium air flow volume region in many cases. As disclosed in Japanese Laid-open Patent Application Publications No. 2004-316625 and No. 2003-314499, if the opening of the blowout opening side is taken wide, in a high air flow volume region where a high air flow volume commensurate therewith is obtained, a corresponding high static pressure is obtained and the static pressure-air flow volume characteristics are improved. As a result, the static pressure efficiency in the high air flow volume region is improved. However, there is a tendency that the static pressure efficiency in the medium air flow volume region is hardly improved, or decreases.

On the other hand, considering the power consumption aspect, if the inner peripheral portion of the casing outer frame of the blowout opening side is inclined outward toward the blowout opening side, as disclosed in FIG. 2D of Japanese Laid-open Patent Application Publication No. 2004-316625, an air flow which spreads outward along the inner peripheral portion is formed. Therefore, the air flow which is ejected from the blowout opening side spreads outward, and so a high air flow volume corresponding to the spent power consumption cannot be obtained.

In addition, if the inner peripheral portion of the casing outer frame is formed in a straight configuration as disclosed in Japanese Laid-open Patent Application Publication No. 2003-314499, That is, the inner peripheral portion of the casing outer frame is formed in a straight inner diameter shape along the central axis as described above, and so the air flow along the inner peripheral portion flows straight along the central axis. Thus, the air flow does not direct the central axis direction, and so the air flow spreads easily toward outside. Then such an air flow which easily spreads outward becomes an air flow which swirls in the vicinity of the blowout opening under the influence of the edge of the inner peripheral portion of the end portion of the blowout opening. The swirling air flow interferes with the air flow which is flowing to the blowout opening direction, and as a result, it becomes a factor of inhibiting the flow (air resistance). When such an air resistance is generated, the load to the motor increases and thus the power consumption increases.

Further, in the configuration shown in FIG. 3A of Japanese Laid-open Patent Application Publication No. 2004-316625, the inner peripheral portion of the casing outer frame is inclined to the central axis direction toward the blowout opening side from the suction opening side, and the air flow which is gotten closer to the central axis direction flows along the straight configuration of the outer peripheral portion of the base portion hub at the center portion. Since the outer peripheral portion has the straight outer diameter shape along the central axis as described above, the air flow along the outer peripheral portion flows straight along the central axis. On the other hand, the inner peripheral portion of the casing outer frame is formed so that the air flow gets closer to the central axis, and so there also exists the air flow which is directed to the central axis direction from outside. In such a case where the straight air flow along the central axis which is present in the inside and the air flow which is directed to the central axis direction from the outside are mixed and the mixed air flows are ejected from the edge portion of the blowout opening, the air flows interfere, and the air flow in the vicinity of the blowout opening is disturbed, and so it becomes a factor (air resistance) of inhibiting smooth ejection of the air flow from the blowout opening. When such an air resistance is generated, the load to the motor increases and the power consumption increases.

Meanwhile, in the configuration shown in FIG. 3A of Japanese Laid-open Patent Application Publication No. 2004-316625, as described above, the straight air flow along the central axis which is present in the inside inhibits the flow of the air flow which is directed to the central axis, and it is considered that the air flow collecting effect to the central axis direction is limited. Therefore, it is estimated that the effect of flowing the air to the electronic equipment in the vicinity of the center is not so large.

From this, in the above described conventional fan, from the view point of the absolute amount of the power consumption, the power consumption increases. Thus, in the case that the above described conventional fan is used in the medium air flow volume region, as described above, there exists a problem that though the static pressure efficiency is hardly improved or decreases, the absolute amount of the power consumption itself becomes larger and the running cost becomes high. Further, from the viewpoint of the cooling capacity, there exists another problem of collecting the air flow to the central axis direction more effectively and sending the air flow to the electronic equipment in the vicinity of the center.

CITATION LIST

Patent Literature

Patent Literature 1: Japanese Patent Application Laid-Open Publication No. 2004-316625

Patent Literature 2: Japanese Patent Application Laid-Open Publication No. 2003-314499

SUMMARY OF INVENTION

Technical Problem

Thus, the present invention has been accomplished in view of the problems described above. It is an object of the present invention to provide an axial flow fan motor which has the static pressure efficiency equal to or higher than that of a conventional axial flow fan motor so as to suppress the absolute amount of power consumption in the medium air flow volume region, and can effectively supply the air to the vicinity of the center.

Solution to Problem

In order to achieve the above object, the present invention can be understood by the following configurations.

(1) An axial flow fan motor of an outer rotor type comprises: a casing outer frame; an impeller disposed to an air suction opening side of the casing outer frame, having a rotor housing and a vane provided around an outer periphery thereof; a rotor shaft disposed at a center of the impeller, functioning as a rotation axis of the impeller; a bearing housing disposed to an inside of the rotor housing and an outer periphery of the rotor shaft, supporting rotatably the rotor shaft; and a base portion hub disposed to an air blowout opening side of the casing outer frame, fixing the bearing housing, wherein, in a cross-sectional view along the rotation axis, the base portion hub has an outer peripheral portion at least partially inclined to the rotation axis side by an angle θ1 toward the air blowout opening side with regard to a straight line parallel to the rotation axis, and the casing outer frame has an inner peripheral portion at least partially inclined to the rotation axis side by an angle θ2 toward the air blowout opening side with regard to a straight line parallel to the rotation axis.

(2) In the above configuration (1), the angle θ1 may be equal to or larger than the angle θ2.

(3) In the above configuration (1), each of the inner peripheral portion of the casing outer frame and the outer peripheral portion of the base portion hub may be inclined to the rotation axis side from an inclination starting point to an end portion of the air blowout opening side.

(4) In the above configuration (1), the inner peripheral portion of the casing outer frame may have an inclination starting point located farther than the outer peripheral portion of the base portion hub viewed from the blowout opening side.

(5) In the above configuration (1), the rotor housing may have a top portion inclined in the air suction opening side so that an air suction opening has a wider opening than a depth side in the rotation axis direction.

(6) In the above configuration (1), the axial flow fan motor may be adapted to be in use in a medium air flow volume region of 0.5 to 1.0 $m^3$/min.

(7) In the above configuration (1), the axial flow fan motor may further comprise a stationary blade connecting the casing outer frame and the base portion hub.

(8) In the above configuration (1), the bearing housing may be secured integrally to the base portion hub when injection molded using a resin.

Advantageous Effects of Invention

According to the present invention, an axial flow fan motor can be provided which has the static pressure efficiency equal to or higher than that of a conventional axial flow fan motor so as to suppress the absolute amount of power consumption in the medium air flow volume region, and can effectively supply the air to the vicinity of the center.

DESCRIPTION OF EMBODIMENTS

Hereinafter, an embodiment for carrying out the present invention (hereinafter, referred to as "embodiment") shall be described with reference to the accompanying drawings. Throughout the description of the embodiment, the same number is given to the same element.

(Overall Configuration of Axial Flow Fan Motor)

Figure 1:
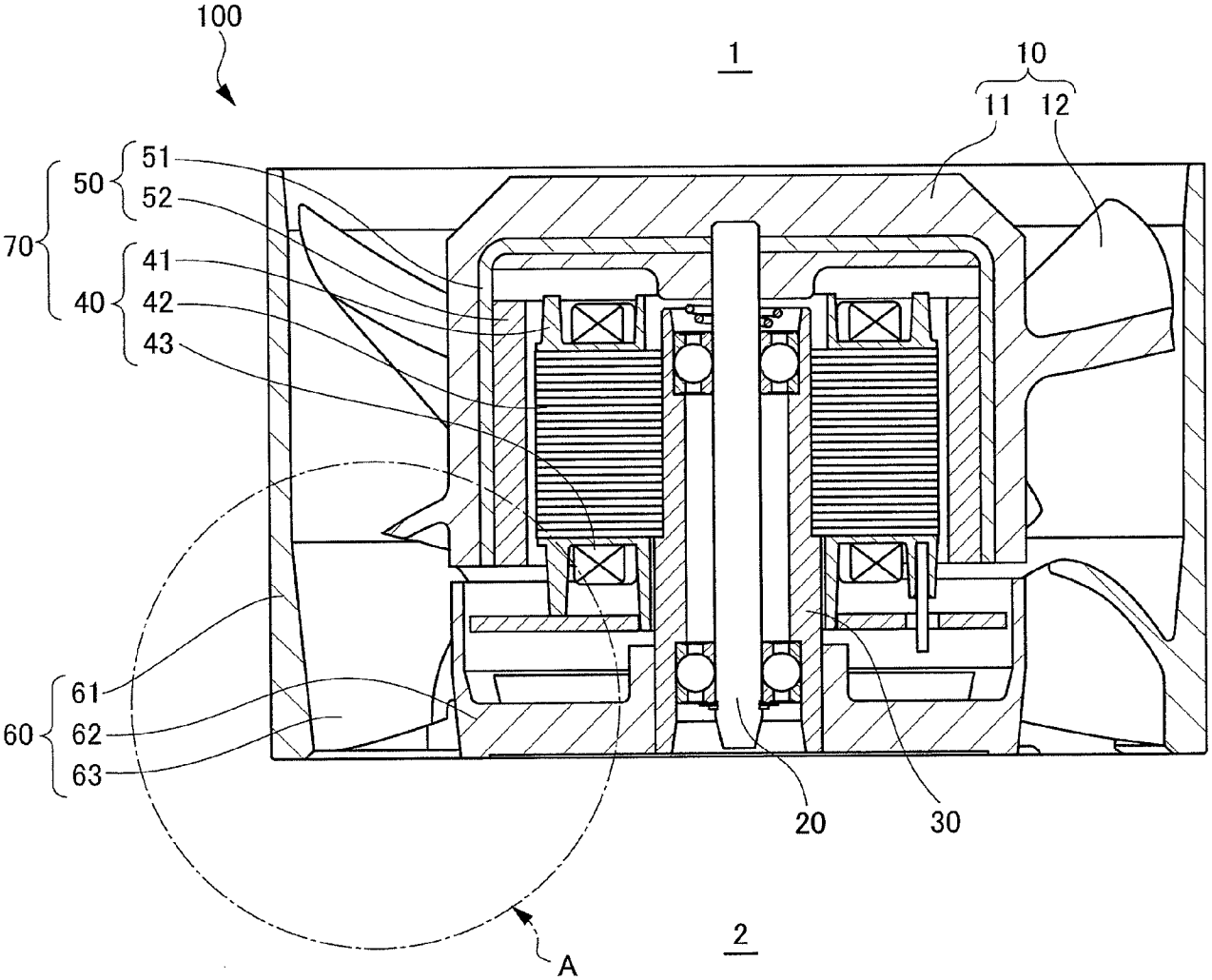
FIG. 1 is a longitudinal cross-sectional view illustrating an overall configuration of an axial flow fan motor.

First, an overall configuration of an axial flow fan motor 100 shall be described based on FIG. 1. FIG. 1 is a longitudinal cross-sectional view illustrating the overall configuration of the axial flow fan motor 100. As shown in FIG. 1, the axial flow fan motor 100 includes an impeller 10, a rotor shaft 20, a bearing housing 30, a stator 40, a rotor 50, and a casing 60. The impeller 10 is provided with a vane 12 on an outer periphery of a rotor housing 11. Further, at the center of the impeller 10, the rotor shaft 20 which is a rotation axis is fixed.

The stator 40 is formed by an insulator 41, a stator core 42 and a coil 43 on the outer circumference of the bearing housing 30. The rotor 50 is formed by a rotor yoke 51 provided integrally inside the rotor housing 11, and a rotor magnet 52 mounted inside the rotor yoke 51.

It should be noted that in the above description, though a case where the rotor 50 is formed by the rotor yoke 51 provided integrally inside the rotor housing 11 is shown, the rotor 50 may be mounted inside the rotor housing 11. Further, though the rotor shaft 20 is fixed to the center of the rotor housing 11 so as to be mounted inside the rotor yoke 51, the rotor shaft 20 may be fixed directly to the rotor housing 11.

The casing 60 includes a casing outer frame 61 which covers the outer periphery of the impeller 10, a base portion hub 62 which secures the bearing housing 30, and a stationary blade 63 which connects the base portion hub 62 and the casing outer frame 61. Note that in the above description, a case where the casing outer frame 61 and the base portion hub 62 are connected by the stationary blade 63 is shown, the casing outer frame 61 and the base portion hub 62 may be connected by such a configuration as a rod-like connecting shaft. Further, the bearing housing 30, when injection molding the casing 60 with a resin, may be fixed so as to integrate the base portion hub 62, but it may be possible to mold the casing 60 in advance and to fix to the portion of the base portion hub 62 later.

And a motor portion 70 is composed of the stator 40 and the rotor 50. By supplying a current to the coil 43 from a power supply (not shown), the impeller 10 rotates about a rotation axis of the rotor shaft 20 which is rotatably supported in the bearing housing 30, and then a so-called outer rotor type axial flow fan motor 100 is formed.

In addition, with regard to the axial flow fan motor 100, as seen in FIG. 1, the upper side is a suction opening side 1, and the lower side is a blowout opening side 2. Accordingly, the axial flow fan motor 100 is provided with the impeller 10 in the suction opening side 1 of the air in the casing outer frame 61, and with the base portion hub 62 in the blowout opening side 2.

Figure 2:
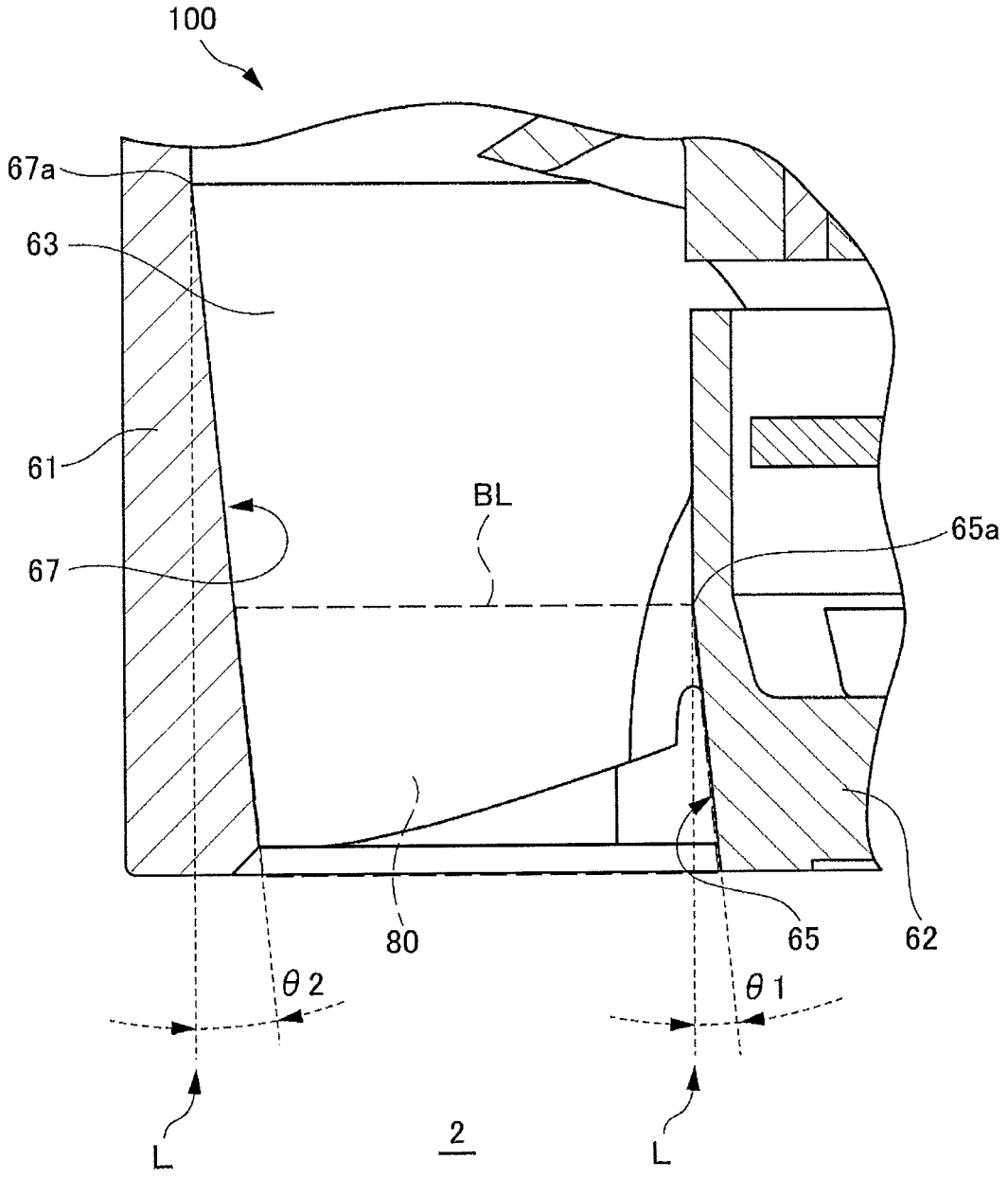
FIG. 2 is an enlarged view of portion A of FIG. 1 and is an explanatory diagram of a configuration of the embodiment.

Further, the axial flow fan motor according to the embodiment of the present invention shall be described based on FIG. 2. FIG. 2 is an enlarged view of the portion A of FIG. 1, and is an explanatory diagram of the configuration of the embodiment. A dotted line L drawn in FIG. 2 illustrates a straight line parallel to the rotation axis (the rotor shaft 20). As can be seen from FIG. 2, an outer peripheral portion 65 of the base portion hub 62 is formed such that a portion in the blowout opening side 2 inclines to the rotation axis side at an angle θ1 toward the blowout opening side 2 with regard to the dotted line L. In addition, an inner peripheral portion 67 of the casing outer frame 61 is also formed such that a portion in the blowout opening side 2 inclines to the rotation axis side at an angle θ2 toward the blowout opening side 2 with regard to the dotted line L. Note that with regard to the angle θ1 and the angle θ2, the angle which is toward the rotation axis based on the straight line parallel to the rotation axis (the dotted line L) is taken plus, and in reverse, the angle which is toward the outside is taken minus. In addition, a broken line BL is, in order to illustrate the positional relationship between an inclination starting point 65*a* of the outer peripheral portion 65 of the base portion hub 62, and an inclination starting point 67*a* of the inner peripheral portion 67 of the casing outer frame 61, a horizontal line extended virtually to the position of the inner peripheral portion 67 of the casing outer frame 61 from the corresponding inclination starting point 65*a* (similar situation in the followings). As shown in FIG. 2, the inclination starting point 67*a* is located at a farther point than the inclination starting point 65*a* as seen from the blowout opening side 2. This takes into consideration that the air flow velocity becomes faster in the casing outer frame 61 than in the base portion hub 62.

Therefore, if only the outer peripheral portion 65 of the base portion hub 62 is simply inclined toward the rotation axis, the opening of the blowout opening side 2 becomes widened. However, because the inner peripheral portion 67 of the casing outer frame 61 is also inclined toward the rotation axis in the same manner, the opening of the blowout opening side 2 is not so widened as that of a conventional configuration in which the opening is widened in order to obtain the air flow volume. Thus, it is not necessary to feed a high air flow volume in order to obtain the air flow volume commensurate with the wide opening as is the case in the conventional configuration, and the decreasing tendency of the static pressure efficiency in the low air flow volume region is suppressed because the static pressure is easily obtained even with less air flow volume.

As shown in FIG. 2, in the axial flow fan motor 100, because the inner peripheral portion 67 of the casing outer frame 61, is inclined to the rotation axis side (central axis direction) toward the blowout opening side 2, the air flow which flows along the inner peripheral portion 67 becomes the air flow directing the rotation axis side (central axis direction), and so it is difficult for the air flow to spread outward. Therefore, it is possible to prevent generation of the air flow which swirls in the vicinity of the blowout opening under the influence of the edge of the inner peripheral portion 67 of the end portion of the blowout opening as described above.

Further, in the axial flow fan motor 100, a flow path 80 in the air blowout opening side 2, which is formed by the base portion hub 62 and the casing outer frame 61, is formed to direct the rotation axis side (central axis direction). Therefore, the entire air flow becomes the air flow which directs the rotation axis side (central axis direction), but on the other hand, because the outer peripheral portion 65 of the base portion hub 62 is also inclined to the rotation axis side (central axis direction) toward the blowout opening side 2, the air flow along the outer peripheral portion 65 also becomes the air flow which directs the rotation axis side (central axis direction). Thus, because the air flow along the outer peripheral portion 65 does not interfere with the flow of the entire air flow which directs the rotation axis side (central axis direction), air flow turbulence in the vicinity of the blowout opening described above is suppressed.

Thus, in the axial flow fan motor 100, the occurrence of the air flow which swirls in the vicinity of the blowout opening and the air resistance caused by the air flow turbulence is suppressed. Therefore, the load on the motor due to the air resistance is reduced, and the power consumption is suppressed.

Further, because both the air flow along the outer peripheral portion 65 and the flow of the entire air flow direct the rotation axis side (central axis direction) as described above, the air flow is ejected to the rotation axis side (central axis direction) smoothly from the blowout opening. Therefore, the air flow is collected effectively to the rotation axis side (central axis direction) and so is sent effectively to the electronic equipment and the like in the vicinity of the center.

Hereunder, the axial flow fan motor 100 according to the embodiment shall be described in detail with reference to FIG. 2 to FIG. 6, in comparison with a comparative example 1 with an axial flow fan motor 200 and a comparative example 2 with an axial flow fan motor 300 which have a configuration of a wide blowout opening side opening each. Note that with regard to the axial flow fan motor 200 according to the comparative example 1 and the axial flow fan motor 300 according to the comparative example 2, configuration components different from the axial flow fan motor 100 according to the embodiment of the present invention described already are described mainly, and the description of the same configuration components is omitted in some cases.

Figure 3:
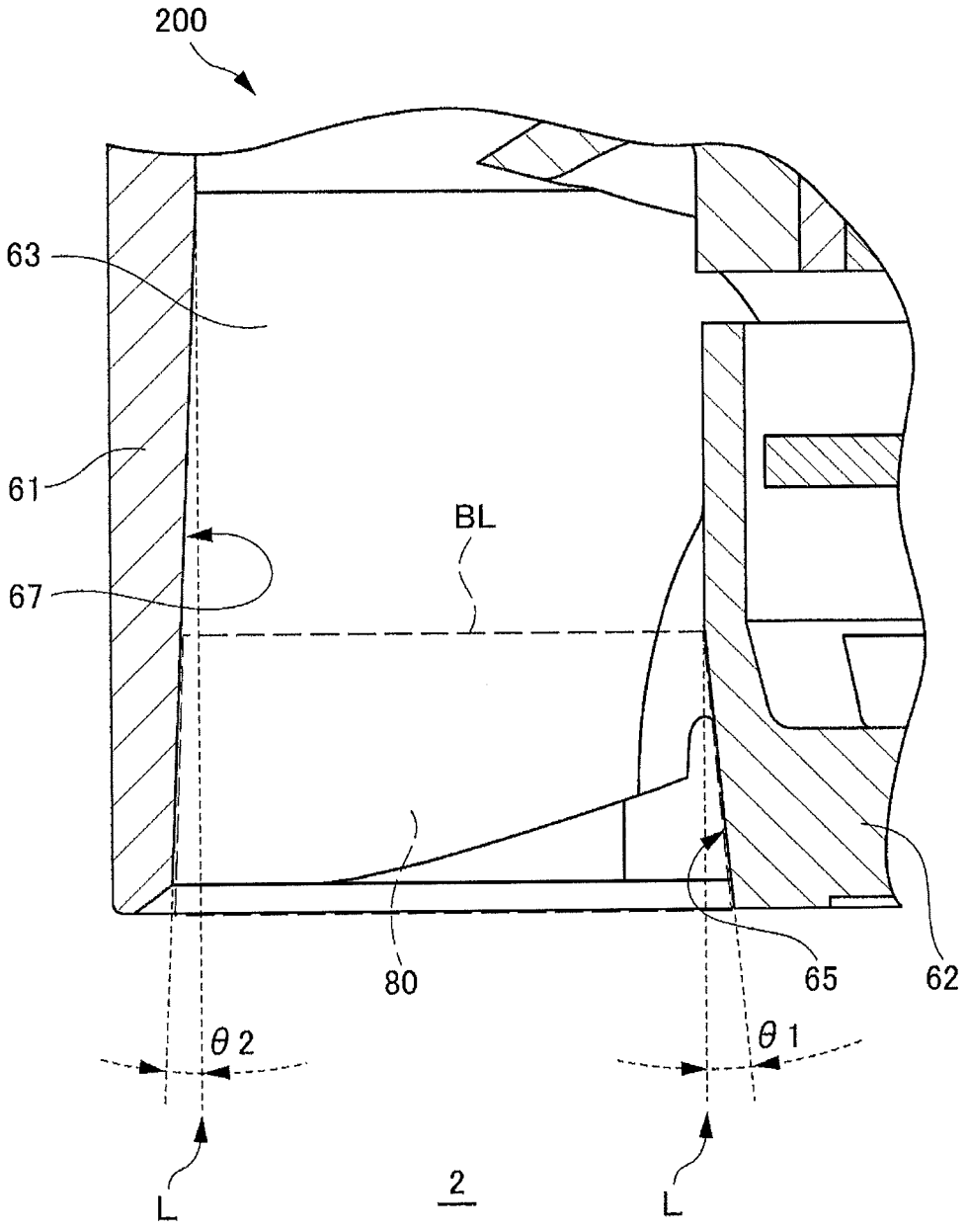
FIG. 3 is an enlarged view of portion A of FIG. 1 and is an explanatory diagram of a configuration of the comparative example 1.
Figure 4:
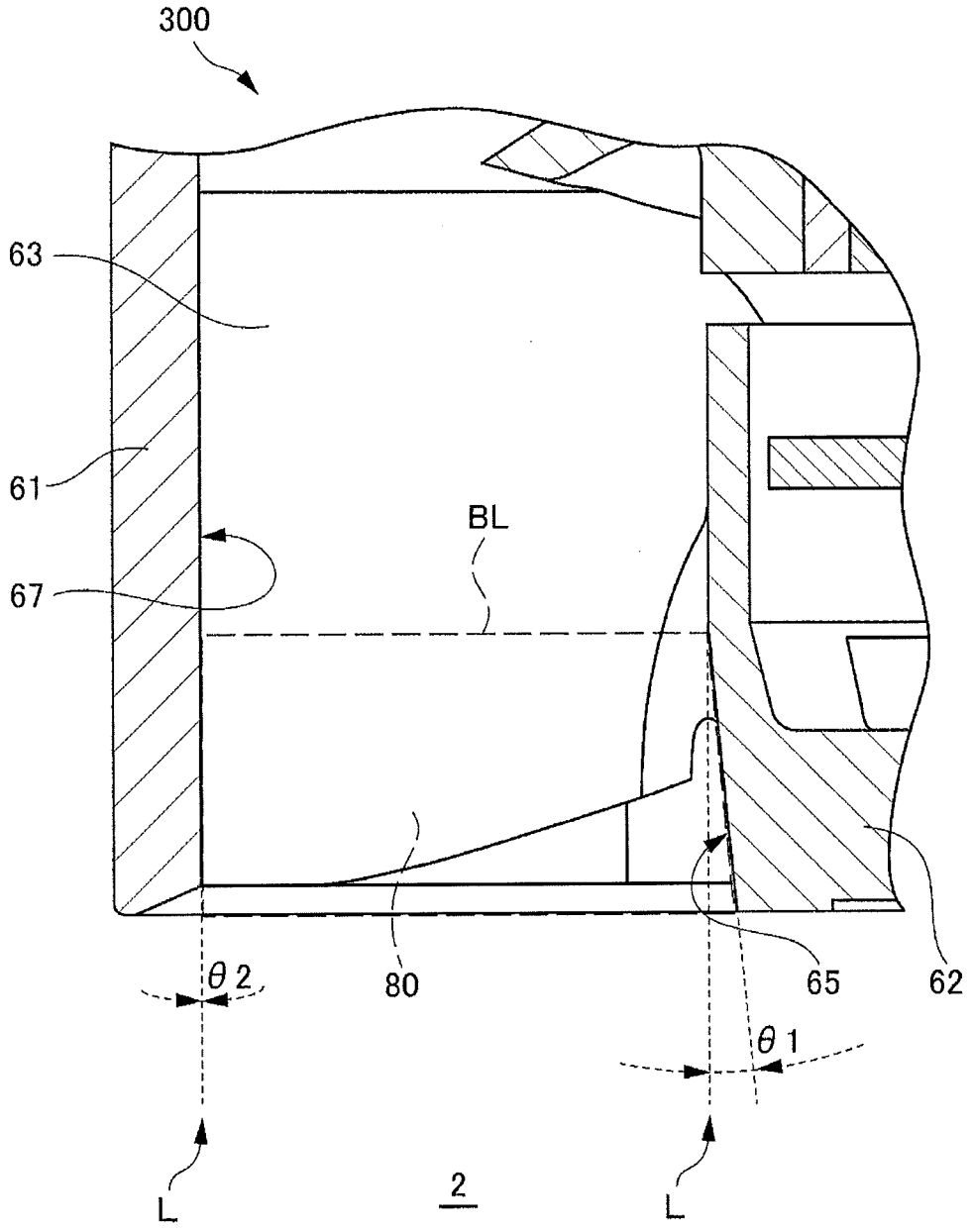
FIG. 4 is an enlarged view of portion A of FIG. 1 and is an explanatory diagram of a configuration of the comparative example 2.

First, the configurations of the axial flow fan motor 100 according to the embodiment (refer to FIG. 2), the axial flow fan motor 200 according to the comparative example 1 (refer to FIG. 3) and the axial flow fan motor 300 according to the comparative example 2 (refer to FIG. 4) are described. FIG. 3 and FIG. 4 are enlarged view of portion A of FIG. 1 respectively. FIG. 3 is an explanatory diagram of the axial flow fan motor 200 of the comparative example 1 and FIG. 4 is an explanatory diagram of the axial flow fan motor 300 of the comparative example 2.

Each of the embodiment, the comparative example 1 and the comparative example 2 has a configuration in which the outer peripheral portion 65 of the base portion hub 62 is inclined to the rotation axis side by the same plus angle of θ1.

On the other hand, each of the embodiment, the comparative example 1 and the comparative example 2, has a different inclination angle θ2 of the inner peripheral portion 67 of the casing outer frame 61. In particular, in the configuration of the axial flow fan motor 100 according to the embodiment shown in FIG. 2, the inclination angle θ2 of the inner peripheral portion 67 is equal to the angle θ1 (θ1=θ2). In other words, the outer peripheral portion 65 and the inner peripheral portion 67 toward the blowout opening side 2 are set so as to form parallel walls each other.

On the other hand, in the configuration of the axial flow fan motor 200 according to the comparative example 1 shown in FIG. 3, the inclination angle θ2 of the inner peripheral portion 67 is taken minus and the outer peripheral portion 65 is inclined outward. In this case, the opening in the blowout opening side 2 is taken wide as is conventional. More specifically, as shown in FIG. 3, the flow path 80 spreads to a trumpet shape toward the blowout opening side 2, and the opening in the blowout opening side 2 grows wide.

Further, in the configuration of the axial flow fan motor 300 according to the comparative example 2 shown in FIG. 4, the inner peripheral portion 67 is not inclined and has a straight configuration. In other words, the angle θ2 is set to be 0° with regard to a straight line parallel to the rotation axis. In this case, the opening in the blowout opening side 2 is also taken wide as is conventional. More specifically, as shown in FIG. 4, the inner peripheral portion 67 is not inclined and has a straight configuration, but because the outer peripheral portion 65 is inclined to the rotation axis side toward the blowout opening side 2, the flow path 80 spreads toward the blowout opening side 2 and the opening in the blowout opening side 2 grows wide.

Figure 5:
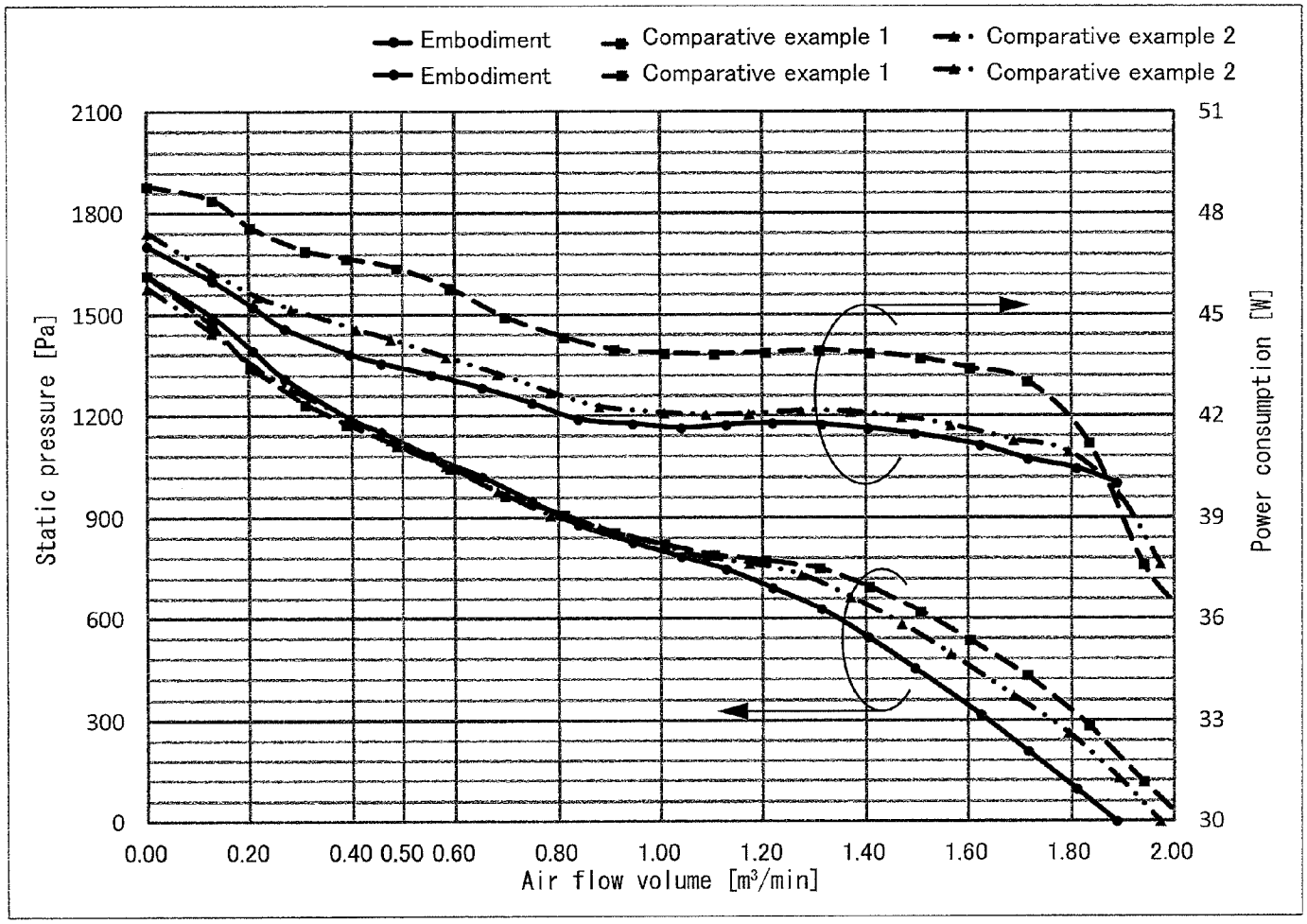
FIG. 5 is a graph illustrating static pressure-air flow volume characteristics and power consumption in the embodiment, the comparative example 1 and the comparative example 2.

Next, the characteristics in the embodiment, the comparative example 1 and the comparative example 2 are described with reference to FIG. 5 and FIG. 6. FIG. 5 is a graph illustrating the static pressure-air flow volume characteristics and the power consumption in the embodiment, the comparative example 1 and the comparative example 2. An air flow volume [$m^3$/min] is taken on the horizontal axis, a static pressure [Pa] is taken on the left vertical axis and a power consumption [W] is taken on the right vertical axis.

As shown in FIG. 5, with regard to the embodiment, in the less air flow volume region for a boundary of the air flow volume of about 0.8 $m^3$/min in the medium air flow volume region (0.5 to 1.0 $m^3$/min) used as an operating point, the higher static pressure is obtained as compared to those in the comparative example 1 and the comparative example 2, and the static pressure-air flow volume characteristics are improved. On the other hand, paying attention to the power consumption, it can be seen that the power consumption is reduced not only in the medium air flow volume region (0.5 to 1.0 $m^3$/min), but also over the almost entire region.

Figure 6:
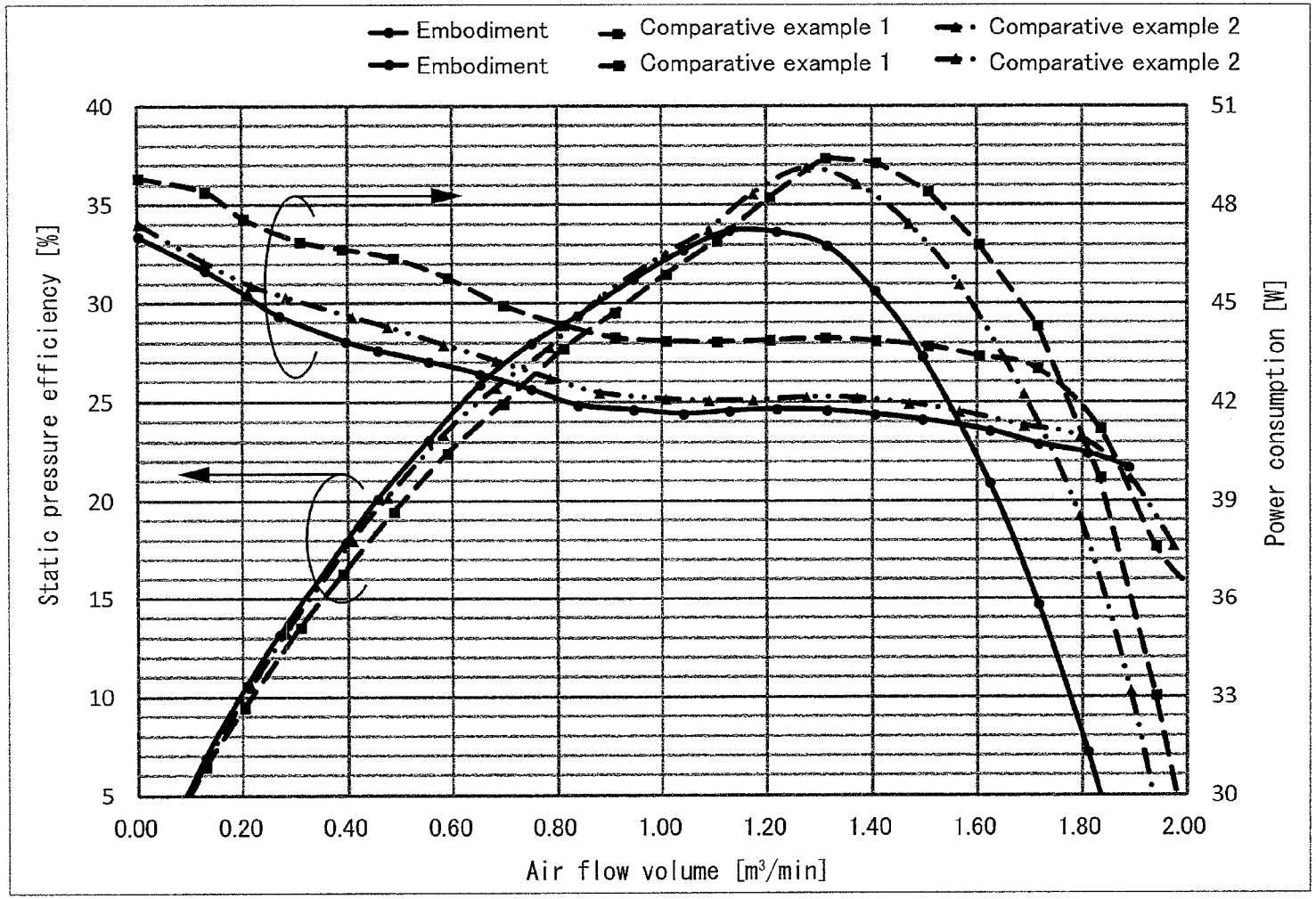
FIG. 6 is a graph illustrating static pressure efficiency and power consumption in the embodiment, the comparative example 1 and the comparative example 2.

Next, the static pressure efficiency obtained by the characteristics is shown in FIG. 6. Here, the static pressure efficiency [%] can be obtained by the following equation.

$$\text{Static pressure efficiency [\%]} = ((\text{Static Pressure [Pa]} \times \text{Air flow volume [m}^3\text{/min]})/\text{Power consumption [W]}) \times 1.6662$$

The static pressure efficiency obtained by the above equation is used commonly and the detailed description is omitted, but as a simple image, it represents the percentage of the energy which has been converted to the air flow volume from the power consumption (energy) which has been input for rotating the impeller 10. Therefore, it means that the high static pressure efficiency characteristics correspond to an axial flow fan motor with high efficiency.

FIG. 6 is a graph illustrating the static pressure efficiency and the power consumption in the embodiment, the comparative example 1 and the comparative example 2. An air flow volume [$m^3$/min] is taken on the horizontal axis, a static pressure efficiency [%] is taken on the left vertical axis and a power consumption [W] is taken on the right vertical axis. As described with reference to FIG. 5, in the region of the air flow volume of about 0.8 $m^3$/min or less, in the embodiment, the static pressure-air flow volume characteristics are improved as compared to those in the comparative example 1 and the comparative example 2, and the power consumption is also reduced. Therefore, in the region of the air flow volume of about 0.8 $m^3$/min or less, as shown in FIG. 6, the static pressure efficiency in the embodiment is clearly improved as compared to those in the comparative example 1 and the comparative example 2. From this, it is understood that in the region of the air flow volume of about 0.8 $m^3$/min or less, in the embodiment, while the higher static pressure efficiency is achieved as compared to those in the comparative example 1 and the comparative example 2, the absolute amount of the power consumption to be used is also reduced.

On the other hand, as shown in FIG. 5, in the region of the air flow volume from about 0.8 to 1.0 $m^3$/min, in the embodiment, the static pressure-air flow volume characteristics are slightly lower than those in the comparative example 1 and the comparative example 2. However, even in this region, as shown in FIG. 5 and FIG. 6, the lower power consumption is achieved in the embodiment as compared to those in the comparative example 1 and the comparative example 2. As a result, the static pressure efficiency shown in FIG. 6 is clearly improved in the embodiment as compared to that in the comparative example 1. Further, in the embodiment, almost the same static pressure efficiency as that in the comparative example 2 is obtained. Therefore, it can be understood that while almost the same static pressure efficiency is achieved, the absolute power consumption to be used is reduced.

From the above, it can be understood with regard to the axial flow fan motor 100 according to the embodiment that while in the entire region of the medium air flow volume region (0.5 to 1.0 $m^3$/min), the static pressure efficiency is equal to or higher as compared to the conventional axial flow fan motor which has a wider opening in the blowout opening side 2, the absolute amount of the power consumption to be used is less and the running cost can be reduced.

Figure 7:
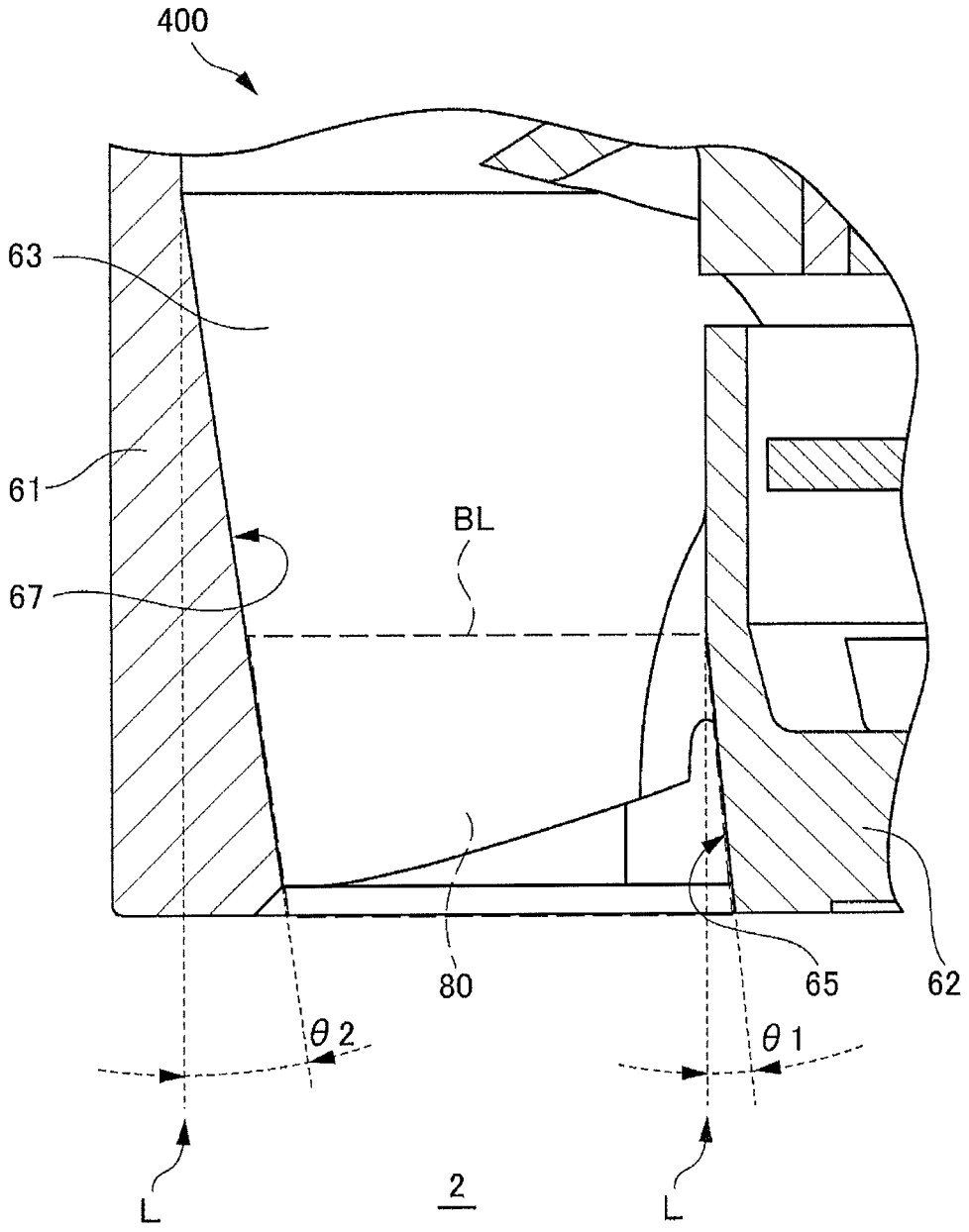
FIG. 7 is an enlarged view of portion A of FIG. 1 and is an explanatory diagram of a configuration of the comparative example 3.

Further, an axial flow fan 400 of comparative example 3 is described with reference to FIG. 7 to FIG. 9. FIG. 7 is an enlarged view of the portion A of FIG. 1 and is an explanatory diagram of the configuration of the comparative example 3. In the axial flow fan motor 100 according to the embodiment, the angle θ1 and the angle θ2 are set to be equal (θ1=θ2), but in the configuration of the comparative example 3 shown in FIG. 7, the angle θ2 is set to be larger by 5° than the angle θ1 (θ2=θ1+5'). In other words, the comparative example 3 has a configuration in which the inner peripheral portion 67 of the casing outer frame 61 is inclined to the rotation axis side further than in the configuration of the embodiment.

Figure 8:
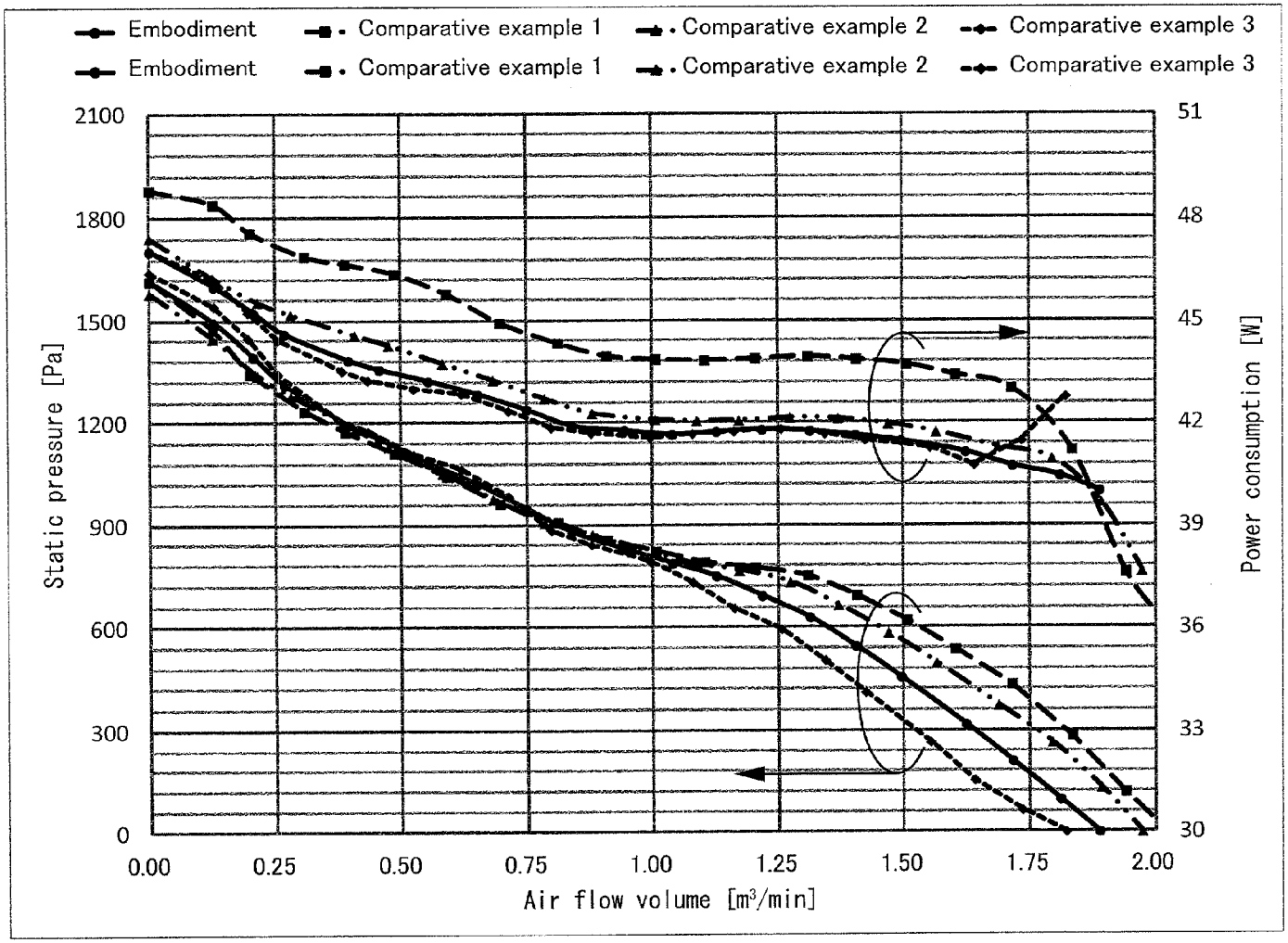
FIG. 8 is a graph obtained by adding the data of the comparative example 3 to the graph of FIG. 5.
Figure 9:
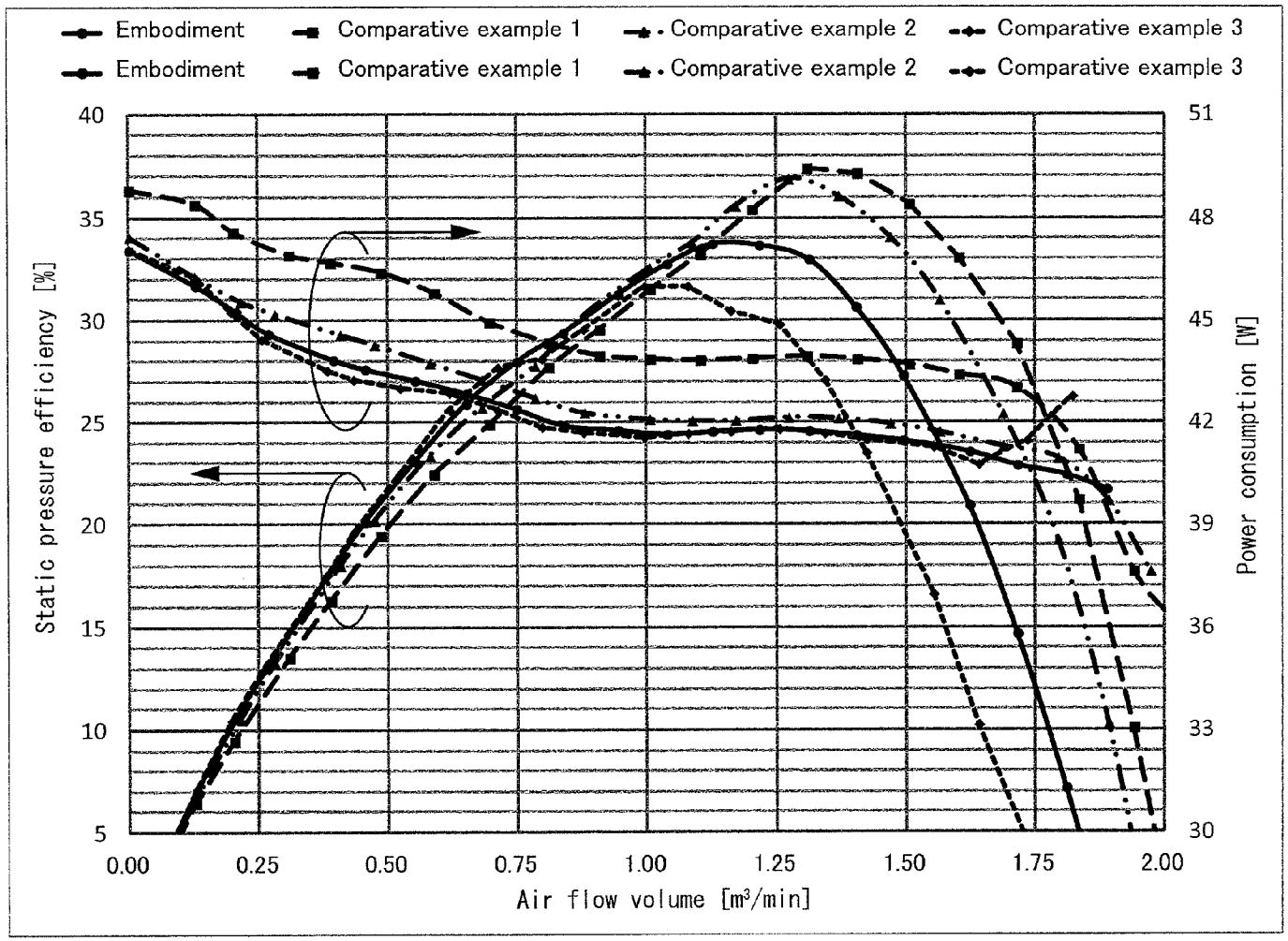
FIG. 9 is a graph obtained by adding the data of the comparative example 3 to the graph of FIG. 6.

Hereunder, referring to FIG. 8 and FIG. 9, the properties of the comparative example 3 are described. FIG. 8 is a graph obtained by adding the data of the comparative example 3 to the graph of FIG. 5. In the same manner, FIG. 9 is a graph obtained by adding the data of the comparative example 3 to the graph of FIG. 6.

As shown in FIG. 8, in the comparative example 3, the power consumption in the medium air flow volume region (0.5 to 1.0 $m^3$/min) is reduced as compared to the embodiment, but decrease of the static pressure-air flow volume characteristics is noticed in the air flow volume region of about 0.75 $m^3$/min or more. As a result, as shown in FIG. 9, in the comparative example 3, it is observed that the static pressure efficiency tends to decrease significantly with increasing air flow volume in the air flow volume region of about 0.75 $m^3$/min or more, and the static pressure efficiency grows lower than the embodiment in the air flow volume region of 0.75 to 1.0 $m^3$/min.

Hereunder, the angle θ1 and the angle θ2 are described further. As described above, in the embodiment and the comparative example 2, the angle θ1 is set to be equal. On the other hand, the angle θ2 is set to be 0° in the comparative example 2, whereas in the embodiment, the angle θ2 is set to be larger than 0° so that the relation "the angle θ1=the angle θ2" is satisfied specifically.

In this case, as shown in FIG. 9, in the medium air flow volume region (0.5 to 1.0 $m^3$/min), the static pressure efficiency which is almost equal to or larger than that in the comparative example 2 is obtained in the embodiment. Further, paying attention to the power consumption, because the absolute amount of the power consumption in the embodiment is reduced as compared to that in the comparative example 2, it can be said that the better results are obtained in the embodiment as compared to those in the comparative example 2. Here, it is anticipated that the static pressure efficiency and the power consumption are getting closer to the properties of the embodiment from the properties of the comparative example 2, when the angle θ2 is brought closer to the angle θ1 beyond 0°. From this, it is believed that by setting the angle θ2 so as to be larger than 0° and bring the angle θ2 closer to the angle θ1, the axial flow fan motor can be obtained which exhibits the static pressure properties equal to or higher than that of the conventional one, whereas in which the absolute amount of the power consumption is kept low.

On the other hand, the angle θ1 is set to be equal too in the embodiment and the comparative example 3, but the angle θ2 in the comparative example 2 is set to be "the angle θ1+5°", and to be larger than that in the embodiment in which the angle θ1 and the angle θ2 are equal. In this case, as shown in FIG. 9, the absolute amount of the power consumption can be kept low in a level equal to or better than that in the embodiment, but in the region exceeding the air flow volume of about 0.75 $m^3$/min, the static pressure efficiency tends to decrease significantly with increasing air flow volume as compared to that in the embodiment. Thus, in order to obtain the axial flow fan motor which exhibits the good static pressure efficiency in the entire medium air flow volume region (0.5 to 1.0 $m^3$/min) and suppress the absolute amount of power consumption, it is believed that setting the θ2 to be equal to or smaller than the angle θ1 is preferable.

Further, with regard to the angle θ1, when it is assumed that the angle θ1=0°, the shape becomes the same one as in the case of the straight configuration of the outer peripheral portion of the base portion hub as described in the conventional art. Therefore, as described above, it is anticipated that while the effect of efficiently collecting the air flow to the rotation axis side (central axis direction) cannot be obtained, load is applied to the motor by the occurrence of the air resistance due to the air flow turbulence in the vicinity of the blowout opening, and the power consumption increases. Thus, it is preferable to set the angle θ1 to be larger than 0°. From the above description, it is believed that setting the angle θ1 and the angle θ2 so as to satisfy "θ1>0°", "θ2>0°" and "θ1≥θ2" is preferable.

In the above description, the present invention has been described with reference to the embodiment, but the technical scope of the present invention is not limited to the scope described in the above embodiment. It is apparent to those skilled in the art that various changes and modifications can be added to the above embodiment. It is apparent from the description of the appended claims that the embodiment added with such changes or modifications is included in the technical scope of the present invention.

REFERENCE SIGNS LIST

1 . . . suction opening side; 2 . . . blowout opening side; 10 . . . impeller; 11 . . . rotor housing; 12 . . . vane; 20 . . . rotor shaft; 30 . . . bearing housing; 40 . . . stator; 41 . . . insulator; 42 . . . stator core; 43 . . . coil; 50 . . . rotor; 51 . . . rotor yoke; 52 . . . rotor magnet; 60 . . . casing; 61 . . . casing outer frame; 62 . . . base portion hub; 63 . . . stationary blade; 65 . . . outer peripheral portion (of base portion hub); 65*a* . . . inclination starting point (of outer peripheral portion of base portion hub); 67 . . . inner peripheral portion (of casing outer frame); 67*a* . . . inclination starting point (of inner peripheral portion of casing outer frame); 70 . . . motor portion; 80 . . . flow path; 100, 200, 300, 400 . . . axial flow fan motor

The invention claimed is:

1. An axial flow fan motor, comprising:

a casing outer frame;

an impeller disposed to an air suction opening side of the casing outer frame, having a rotor housing and a vane disposed around an outer periphery thereof;

a rotor shaft disposed at a center of the impeller, functioning as a rotation axis thereof;

a bearing housing disposed to an inside of the rotor housing and an outer periphery of the rotor shaft, supporting rotatably the rotor shaft; and a base portion hub disposed to an air blowout opening side of the casing outer frame, fixing the bearing housing, wherein, in a cross-sectional view along the rotation axis, the base portion hub has an outer peripheral portion at least partially inclined to a rotation axis side by an angle θ1 toward the air blowout opening side with regard to a straight line parallel to the rotation axis, and the casing outer frame has an inner peripheral portion which is at least partially inclined toward the rotation axis at an angle θ2 with respect to a straight line parallel to the rotation axis as the inner peripheral portion approaches the air blowout opening side.

2. The axial flow fan motor according to claim 1, wherein the angle θ1 is equal to or larger than the angle θ2.

3. The axial flow fan motor according to claim 1, wherein each of the inner peripheral portion of the casing outer frame and the outer peripheral portion of the base portion hub is inclined to the rotation axis side from an inclination starting point to an end portion of the air blowout opening side.

4. The axial flow fan motor according to claim 1, wherein the inner peripheral portion of the casing outer frame has an inclination starting point located farther than the outer peripheral portion of the base portion hub viewed from the air blowout opening side.

5. The axial flow fan motor according to claim 1, wherein the rotor housing has a top portion inclined in the air suction opening side so that an air suction opening has a wider opening than a depth side in the rotation axis direction.

6. The axial flow fan motor according to claim 1, wherein the axial flow fan motor is adapted to be in use in a medium air flow volume region of 0.5 to 1.0 $m^3$/min.

7. The axial flow fan motor according to claim 1, further comprising a stationary blade connecting the casing outer frame and the base portion hub.

8. The axial flow fan motor according to claim 1, wherein the bearing housing is secured integrally to the base portion hub when injection molded using a resin.

* * * * *